United States Patent [19]

Talley

[11] 4,108,379

[45] Aug. 22, 1978

[54] PAINT SPRAY TIP RETAINING AND CLEANING ADAPTER

[76] Inventor: Herbert Joseph Talley, 1241 Rock Springs Rd., San Marcos, Calif. 92069

[21] Appl. No.: 780,027

[22] Filed: Mar. 22, 1977

Related U.S. Application Data

[63] Continuation-in-part of Ser. No. 644,763, Dec. 29, 1975, abandoned.

[51] Int. Cl.[2] ..... B05B 15/02

[52] U.S. Cl. ..... 239/119; 239/600

[58] Field of Search ..... 239/106, 119, 526, 532, 239/600

[56] References Cited

U.S. PATENT DOCUMENTS

| | | | |
|---|---|---|---|
| 2,743,959 | 5/1956 | Nelson et al. | 239/119 X |
| 3,166,252 | 1/1965 | O'Brien et al. | 239/600 X |
| 3,477,647 | 11/1969 | Grundman et al. | 239/600 X |
| 3,563,463 | 2/1971 | Walker et al. | 239/119 |
| 3,700,174 | 10/1972 | Beck | 239/526 |

*Primary Examiner*—Robert W. Saifer

*Attorney, Agent, or Firm*—Brown & Martin

[57] ABSTRACT

A mounting and cleaning adapter for use with a spray gun in which the spray tip is normally non-reversible and projects through a retaining nut in the paint spray position. The adapter comprises outer and inner sleeves for mounting the tip in a reversed cleaning position or in a spraying position. The outer sleeve is an elongated retaining nut which threadably engages to the spray gun for retaining the tip on the outer end of the inner sleeve, in the paint spray position and in the cleaning position within the outer sleeve. In the cleaning position, the inner sleeve receives the length and diameter of the barrel of the spray tip restraining the same within the outer sleeve. The fluid from the spray gun is forced backwards through the spray tip orifice dislodging accumulated debris.

6 Claims, 5 Drawing Figures

PAINT SPRAY TIP RETAINING AND CLEANING ADAPTER

CROSS REFERENCE TO RELATED APPLICATION

This is a Continuation-In-Part of my application Ser. No. 644,763, filed Dec. 29, 1975, now abandoned.

BACKGROUND OF THE INVENTION

A commonly encountered problem with most pressurized fluid spray equipment presently in use is that debris sometimes accumulates in the tip orifice and is trapped therein, clogging the orifice. Once clogged, the apparatus is useless since very little fluid can be forced through the spray tip. Such problems are quite pronounced for applications such as painting. Many popular paints are of the quick drying type and there is a tendency for paint to form solids and occlude the spray tip orifice.

In the prior art, it has been common to clean the spray tip by removing it from the spray gun and inserting a pin or needle into the orifice and then soaking the tip in a solvent. This operation has several drawbacks. Firstly, the spray tip orifice is defined by a sharp thin edge. Consequently, it is difficult to avoid injuring the edge while dislodging the debris. Since spray tips are rather expensive, this procedure often results in ruining the tips thereby increasing equipment cost. Another disadvantage with the use of a needle and solvents is that the operation requires a substantial amount of time because of the extreme care that must be taken, and consequently, the painting process is slowed. Often the painter is hampered because the paint deposited on his hands decreases his manipulative skills.

The prior art has attempted to solve this problem but with little success. The devices of the prior art support the spray tip in an adapter that is reversible, so as to reverse the position of the spray tip with respect to the gun. The fluid from the spray gun is then utilized to force the debris out of the orifice. The major problem associated with the prior art devices is that they are generally restricted for use with spray equipment of a particular manufacturer. Also, these devices are rather complicated and expensive, and can require costly modifications in the nozzle of the spray gun.

There has, therefore, been a need for a device that conveniently and quickly dislodges the debris from a spray tip, without injuring the orifice. The need extends to a device that is inexpensive and useful with any spray gun.

SUMMARY OF THE INVENTION

An exemplary embodiment of the invention is designed to be utilized with virtually any conventional spray gun. It is to be understood that the invention is not to be restricted by the structural limitations of the particular spray gun, herein disclosed. Furthermore, the spray gun disclosed in connection with the invention is a paint spray gun. The invention has application to any pressurized fluid spray gun, apart from painting equipment, and therefore, the invention shall not be considered limited to the painting field.

A conventional paint spray gun has a handle and an actuator or trigger pivotally connected to the handle. The trigger actuates a valve stem that permits the introduction of pressurized paint from a supply pipe into the spray gun. The spray tip is normally carried by a retainer nut that threadably engages a housing on the spray gun. The spray tip has a barrel part that terminates in a circumferential lip or flange. The spray tip orifice is gradually stepped down from a large diameter to a very small diameter. As a consequence, when debris lodges in the orifice in the larger diameter areas, it cannot be pushed through the smallest diameter. However, reversal of the spray tip permits the pressurized fluid to dislodge the debris and remove it from the orifice. Accordingly, the retainer nut is replaced with an adapter in which an inner sleeve is received within an outer sleeve. The outer sleeve threadably engages the spray tip housing. The forward end of the outer sleeve has an opening defined by an inward flange. The opening is slightly greater in diameter than that of the barrel. Therefore, the outer sleeve can accommodate the spray tip in either the spray or reversed positions. In the spray position, the barrel projects through the opening. In the cleaning position, the barrel projects within the outer sleeve toward the spray gun. The inner sleeve is received within the outer sleeve and in either spray or cleaning positions, the inner sleeve contacts one of the sides of the lip or annular flange. The inner sleeve extends substantially the entire length of the unthreaded part of the outer sleeve. It is under compression by contacting the leading edge of the housing and the lip. In the spray tip reversed position, the sleeve is received over the barrel of the spray tip and restrains the spray tip by forcing the lip against the outer sleeve flange. In this manner pressurized paint is injected into the orifice in the reverse direction, thereby dislodging any debris that may have accumulated therein.

It is therefore an object of the invention to provide a new and improved spray tip cleaning apparatus.

Another object of the invention is to provide a new and improved spray tip cleaning apparatus that utilizes pressurized fluid of a spray gun to dislodge accumulated debris.

Another object of the invention is to provide a new and improved spray tip cleaning apparatus that dislodges debris by reversing the spray tip.

Another object of the invention is to provide a new and improved spray tip cleaning apparatus that is convenient to use and requires no difficult manipulation.

Another object of the invention is to provide a new and improved spray tip cleaning apparatus that is reliable, durable and inexpensive.

The above and other objects of the invention will be apparent as the description continues and when read in conjunction with the appended drawings.

DESCRIPTION OF THE PREFERRED EMBODIMENT

Figure 1:
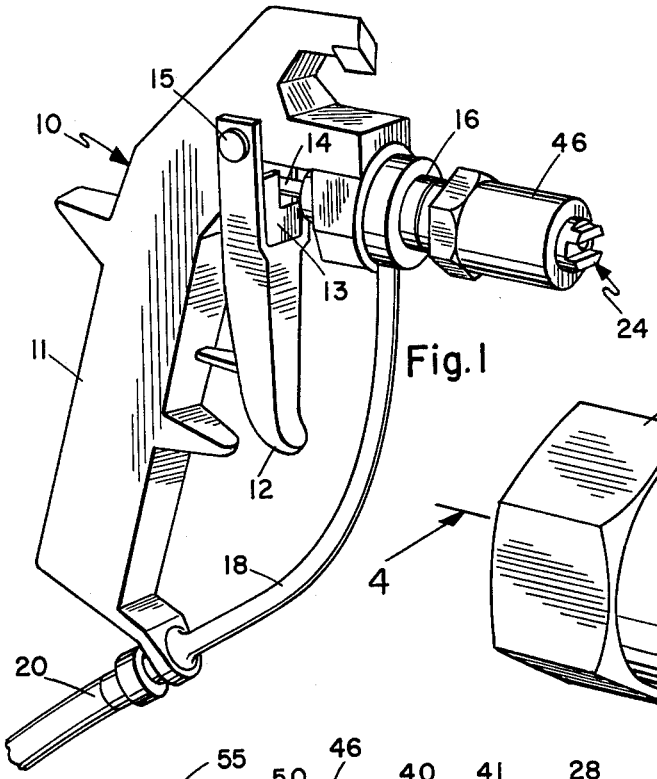
FIG. 1 is a perspective view of a typical spray gun with the adapter attached.
Figure 3:
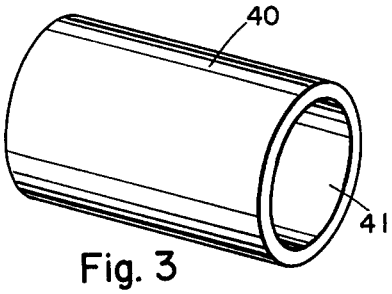
FIG. 3 is a perspective view of the inner sleeve of the adapter.
Figure 2:
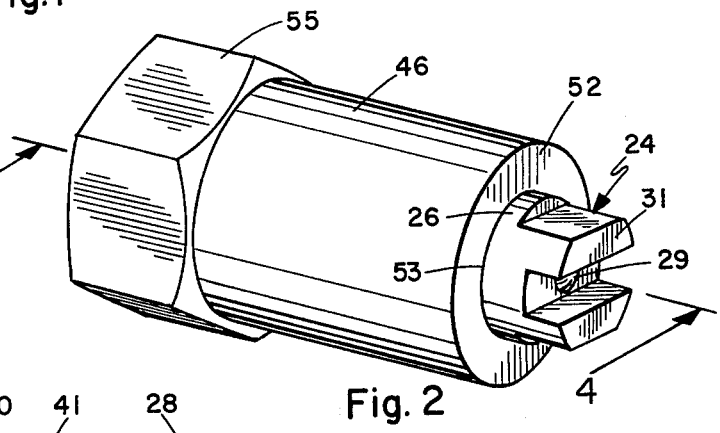
FIG. 2 is an enlarged perspective view of the adapter and spray tip.
Figure 4:
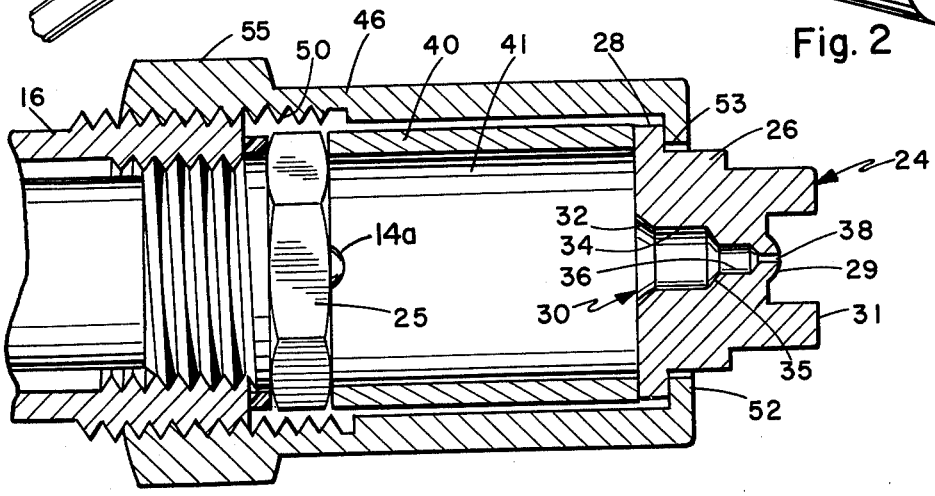
FIG. 4 is an enlarged sectional view taken on line 4–4 of FIG. 2.
Figure 5:
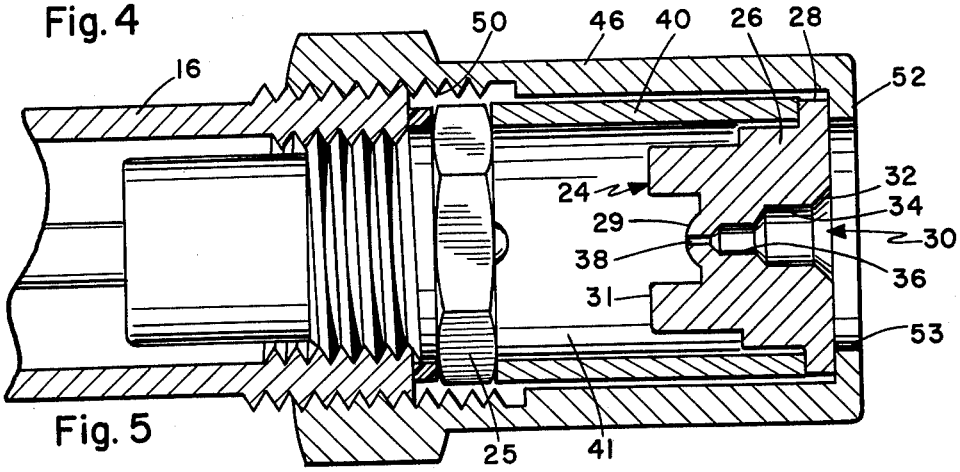
FIG. 5 is a similar sectional view, but with the spray tip reversed for cleaning.

A preferred embodiment of the invention is used in conjunction with a conventional spray gun 10 as illustrated in FIG. 1. Conventional spray guns of the type illustrated comprise a handle 11, and a trigger 12 is pivotally connected to the handle 11 at 15. The trigger includes a yoke 13 that is connected to a valve stem 14 of a needle valve 14a, that valve being engaging a valve seat (not shown) in a valve member 25 mounted within the open end of a threaded housing 16. Depressing the trigger 12 moves the valve and introduces pressurized paint from the supply pipe 20, through the spray gun pipe 18 and into the housing 16. The paint is then forced through the spray tip 24, which is normally held in place against the outer face of the valve seat 25 by a retaining nut, not shown.

The spray tip 24 is of conventional construction and is characterized by a barrel 26 and a rear lip 28 or annular flange. The orifice exit area is depressed from the front face 31 of the spray tip 24. The orifice 30 steps down in diameter from front to back, comprising a generally conically shaped part 32, a cylindrical part 34 of smaller diameter, a conical part 35, another cylindrical part 36 of smaller diameter and finally a needle size perforation 38 at the face thereof. The perforation 38 is formed in a small bead or pimple 29 that projects forward into the orifice exit area. During the spraying procedure, debris has a tendency to accumulate in sections 32, 34, 35, and 36 which are substantially wider than the perforation 38. As a result, the pressurized paint is unable to force the debris through the perforation 38 and the flow of paint may be slow or even cease.

The adapter of the instant invention replaces the conventional retaining nut and is designed to mount or accommodate the spray tip 24 in both the paint spray position, and in a reversed cleaning position so that accumulated debris may be forced back out of the sections 32, 34, 35, and 36. Accordingly, the adapter comprises an outer sleeve 46. The sleeve 46 has threads 50 along a part of its interior and is designed to threadably engage the existing threads on housing 16. The interior diameter of the outer sleeve 46 is slightly greater than the diameter of the lip 28 so as to accommodate insertion and removal of the spray tip 24 without jamming against the interior walls of the outer sleeve 46. The front of the outer sleeve 46 is defined by an inwardly projecting annular flange 52. The flange defines a hole 53 that is slightly wider than the diameter of the barrel section 26. The rear of sleeve 46 defines lands 55 for gripping by a wrench. An inner sleeve 40 is received within the outer sleeve 46 in both the spray tip 24 painting and cleaning positions. The sleeve 40 has an outer diameter that is slightly smaller than the inside diameter of the outer sleeve 46 to permit the inner sleeve 40 to be inserted and removed without jamming. The length of the inner sleeve 40 corresponds substantially to the length of the unthreaded interior part of sleeve 46 for receiving and accommodating the length of barrel 26 of the tip 24. The wall thickness of the inner sleeve 40 is such that the passage 41 to the pressurized paint is the same through the housing 16 and the sleeve 40. Furthermore, the interior diameter of the sleeve 40 is designed such that it is slightly greater than the diameter of the barrel 26 for receiving the barrel in the reversed position. In the paint spray position, the leading edge of the housing 16 contacts the sleeve 40 and forces the same to engage the lip 28 locking the spray tip 24 in the painting position. To clean the spray tip 24, the outer sleeve 46 is unscrewed from the housing 16. The inner sleeve 40 is removed, and the spray tip 24 is also removed. The spray tip 24 is then reversed such that the barrel 26 projects inwardly toward the spray gun 10. The inner sleeve 40 is reinserted and slips over the barrel 26 to again contact the lip 28. The outer sleeve 46 is then threaded to the housing 16 such that the leading edge of the housing 16 engages the sleeve 40 restrain the lip 28 between the leading edge of the inner sleeve 40 and the flange 52. In this manner the perforation 38 confronts the pressurized paint and an unrestricted path is presented for removing the accumulated debris. After the orifice 30 is cleaned, the procedure is repeated, but the spray tip 24 is again reversed and assumes its painting position. Thus, no auxiliary or companion equipment is necessary to clean the spray tip, and the pressurized paint in the spray gun 10 is utilized as the vehicle for dislodging debris.

Alternately the original retaining nut may be retained for mounting the tip in the conventional position for spraying. The cleaning adapter comprising inner sleeve 40 and outer sleeve, or retaining nut 46 may then be used solely for cleaning the tip. This would provide direct communication between the needle valve and the bore of the tip 24. This would also eliminate the chamber or cavity formed between the valve seat 25 and the tip 24 that exists when the adapter 40, 48 is used to mount the tip for spraying.

Modifications and adaptations of the method and materials of the fabrication, in the configuration and assemblage of the constituent elements, are readily permissible within the scope of the invention, which changes are intended to be embraced therewithin.

Having described my invention, I now claim:

1. A cleaning adapter adapted for use with a spray gun of the type having a unidirectional non-reversible spray tip of the type having a barrel with an orifice at one end and an annular retaining flange at the other end detachably mounted normally by a retainer nut directly to the spray gun housing at the outlet of the spray control valve, said adapter comprising:

an elongated inner sleeve having an inner diameter for accommodating said barrel of said spray tip in the reverse direction and having a length exceeding the length of said spray tip between said retaining flange and said one end for accommodating said tip in the reverse direction and having an inner end for engaging said spray gun housing and an outer end for engaging said retaining flange; and an elongated retaining sleeve having an inner end for engaging said housing, a length and a diameter for accommodating said spacer sleeve and said barrel of said tip and an inwardly extending flange at the outer end for engaging said retaining flange for accommodating and retaining said tip on the outer end of said sleeve in either the forward direction for normal spraying or in a reverse direction for dislodging debris from the orifice of said tip.

2. The cleaning adapter of claim 1, wherein said outer sleeve includes threads at the inner end thereof for threadably engaging complementary threads on said housing.

3. The cleaning adapter of claim 2, wherein the spray gun control valve includes a seat member, and the inner end of said inner sleeve engages the spray gun valve seat member.

4. The cleaning adapter of claim 1 in combination with a spray gun of the type including a housing having an outwardly extending cylindrical housing member for non-reversibly mounting a detachable nonreversible spray tip only in a forwardly directed spraying position, a detachable spray tip having a generally cylindrical body defining a barrel having an inner end normally abutting said housing member and an annular radially outwardly extending flange at said inner end for engagement by a retaining nut for mounting said tip on said housing, said barrel of said spray tip extending outwardly beyond said retaining nut and terminating at an outer end with a face including an orifice and a bore communicating with said orifice.

5. The combination of claim 4 wherein said outwardly extending cylindrical housing member includes threads on the outer surface thereof for engagement with the threads at the inner end of said outer sleeve.

6. The combination of claim 5 wherein said outwardly extending cylindrical housing includes a cylindrical bore, threads formed in said bore, a valve seat member threadably mounted in said bore, and a needle valve mounted in said housing and engagable with a seat in said valve seat member for controlling the spray of a fluid from said spray gun through said tip.

* * * * *